US011629856B2

(12) United States Patent
Na et al.

(10) Patent No.: US 11,629,856 B2
(45) Date of Patent: Apr. 18, 2023

(54) APPARATUS FOR MANAGING COMBUSTION OPTIMIZATION AND METHOD THEREFOR

(71) Applicant: DOOSAN ENERBILITY CO., LTD, Changwon-si (KR)

(72) Inventors: Sang Gun Na, Yongin-si (KR); Jwa Young Maeng, Yongin-si (KR); Jee Hun Park, Gwangmyeong-si (KR)

(73) Assignee: DOSAN ENERBILITY CO., LTD., Changwon (KR)

( * ) Notice: Subject to any disclaimer, the term of this patent is extended or adjusted under 35 U.S.C. 154(b) by 268 days.

(21) Appl. No.: 16/574,077

(22) Filed: Sep. 17, 2019

(65) Prior Publication Data

US 2020/0166205 A1 May 28, 2020

(30) Foreign Application Priority Data

Nov. 26, 2018 (KR) ..... 10-2018-0147790

(51) Int. Cl.

*F23N 5/00* (2006.01)
*F22B 37/38* (2006.01)
*F22B 35/18* (2006.01)

(52) U.S. Cl.

CPC ..... *F22B 35/18* (2013.01); *F22B 37/38* (2013.01)

(58) Field of Classification Search

CPC ..... F22B 35/18; F22B 37/38; F23N 5/00
See application file for complete search history.

(56) References Cited

U.S. PATENT DOCUMENTS 5,452,687 A * 9/1995 Christiansen ..... F22B 35/008 122/448.3
2005/0230490 A1* 10/2005 Pouchak ..... F24D 12/02 237/81
2011/0093182 A1 4/2011 Weber et al.
(Continued)

FOREIGN PATENT DOCUMENTS

CN 106247396 A 12/2016
DE 102007061604 A1 6/2009
JP 5452906 B2 3/2014
(Continued)

OTHER PUBLICATIONS

Matsko et al, Optimal Boiler Load Allocation in Distributed Control, 1982, American Control Conference (Year: 1982).*
(Continued)

*Primary Examiner* — Steven S Anderson, II
(74) *Attorney, Agent, or Firm* — Harvest IP Law, LLP

(57) ABSTRACT

An apparatus for managing combustion optimization is provided. The apparatus for managing combustion optimization includes a data collector configured to collect real-time data that is measured in real time from a boiler system including a boiler and a combustion controller configured to control combustion of the boiler, a management configured to determine whether to perform combustion optimization of the boiler based on the real-time data, and an executor configured to generate a control command and transmit the control command to the combustion controller to perform the combustion optimization of the boiler in response to determining that the combustion optimization of the boiler is possible.

8 Claims, 5 Drawing Sheets

(56) References Cited

U.S. PATENT DOCUMENTS

2016/0091203 A1 3/2016 Wang et al.

FOREIGN PATENT DOCUMENTS

| | | | |
|---|---|---|---|
| KR | 1020100078286 | A | 7/2010 |
| KR | 101041467 | B1 | 6/2011 |
| KR | 101545335 | B1 | 8/2015 |
| KR | 101810968 | B1 | 12/2017 |

OTHER PUBLICATIONS

Brummel et al., EP2706422 and translation, 2014.*
A Korean Office Action dated Oct. 1, 2019 in connection with Korean Patent Application No. 10-2018-0147790 which corresponds to the above-referenced U.S. application.
Development of An Artificial Intelligence Algorithm based Combustion Optimization Technique for The Tangential Fired Boiler of Power Plant in India.

* cited by examiner

APPARATUS FOR MANAGING COMBUSTION OPTIMIZATION AND METHOD THEREFOR

CROSS-REFERENCE TO RELATED APPLICATION

This application claims priority to Korean Patent Application No. 10-2018-0147790, filed on Nov. 26, 2018, the disclosure of which is incorporated by reference herein in its entirety.

BACKGROUND

Field

Apparatuses and methods consistent with exemplary embodiments relate to an optimization management technology, and more particularly, to an apparatus for managing combustion optimization of a boiler and a method therefor.

Description of the Related Art

A boiler of a coal-fired power plant heats water by using the exothermic reaction that occurs during coal combustion and produces steam required for power generation. At this time, contaminated exhaust gas such as nitrogen oxide is generated, and if the amount of generated gas is large, the treatment cost increases to manage it, and in case of incomplete combustion, combustion efficiency reduces and the power generation/operation cost increases. Accordingly, combustion optimization of the boiler of the coal-fired power plant is required.

When optimizing the combustion of the boiler of the coal-fired power plant, it is necessary to determine whether to perform combustion optimization according to a state of the boiler of the power plant. If the determination is wrong, the combustion condition of the boiler may become unstable and the efficiency of the boiler and the entire power plant may be reduced, thereby causing the emergency shut-down situation of the power plant. Accordingly, it is necessary to develop a technology of confirming the state of the boiler of the power plant and appropriately determining whether to perform the combustion optimization.

SUMMARY

Aspects of one or more exemplary embodiments provide an apparatus for managing combustion optimization capable of confirming a state of a boiler and determining whether to perform the combustion optimization and a method therefor.

Additional aspects will be set forth in part in the description which follows and, in part, will become apparent from the description, or may be learned by practice of the exemplary embodiments.

According to an aspect of an exemplary embodiment, there is provided an apparatus for managing combustion optimization including: a data collector configured to collect real-time data that is measured in real time from a boiler system including a boiler and a combustion controller configured to control combustion of the boiler, a management configured to determine whether to perform combustion optimization of the boiler based on the real-time data, and an executor configured to generate a control command and transmit the control command to the combustion controller to perform the combustion optimization of the boiler in response to determining that the combustion optimization of the boiler is possible.

The management may determine whether to perform the combustion optimization of the boiler according to a predetermined condition by analyzing operation data in the real-time data, determine whether to perform the combustion optimization of the boiler according to the predetermined condition by analyzing a state binary value in the real-time data, or determine whether to perform the combustion optimization of the boiler through knowledge-based analysis that considers a predetermined range of operation data in the operation data and a value due to an influence between the operation data.

The management may include a boiler management configured to determine whether a state of the boiler may perform the combustion optimization of the boiler by analyzing the real-time data and a combustion control management configured to determine whether a state of the combustion controller configured to control the combustion of the boiler may perform the combustion optimization of the boiler by analyzing the real-time data.

If the boiler management determines that the state of the boiler may perform the combustion optimization of the boiler and the combustion control management determines that the state of the combustion controller configured to control the combustion of the boiler may perform the combustion optimization of the boiler, the executor may transmit the generated control command to the combustion controller to perform the combustion optimization.

The real-time data may include operation data and a state binary value measured from the boiler and the combustion controller.

According to an aspect of another exemplary embodiment, there is provided an apparatus for managing combustion optimization including: a combustion management configured to collect real-time data that is measured in real time from a boiler system including a boiler and a combustion controller configured to control combustion of the boiler, and to determine whether to perform combustion optimization by analyzing the collected real-time data, and an optimal layer configured to calculate a target value for the combustion optimization by using the combustion controller, and to output a control signal according to the calculated target value.

The combustion management may include a data collector configured to collect the real-time data, a management configured to determine whether to perform the combustion optimization of the boiler based on the real-time data, and an executor configured to generate a control command and transmit the control command to the combustion controller to perform the combustion optimization of the boiler in response to determining that the combustion optimization of the boiler is possible.

The management may determine whether to perform the combustion optimization of the boiler according to a predetermined condition by analyzing operation data in the real-time data, determine whether to perform the combustion optimization of the boiler according to the predetermined condition by analyzing a state binary value in the real-time data, or determine whether to perform the combustion optimization of the boiler through knowledge-based analysis that considers a predetermined range of operation data in the operation data and a value due to an influence between the operation data.

The management may include a boiler management configured to determine whether a state of the boiler may perform the combustion optimization of the boiler by analyzing the real-time data, and a combustion control management configured to determine whether a state of the combustion controller configured to control the combustion of the boiler may perform the combustion optimization of the boiler by analyzing the real-time data.

If the boiler management determines that the state of the boiler may perform the combustion optimization of the boiler and the combustion control management determines that the state of the combustion controller configured to control the combustion of the boiler may perform the combustion optimization of the boiler, the executor may transmit the generated control command to the combustion controller to perform the combustion optimization.

The real-time data may include operation data and a state binary value measured from the boiler and the combustion controller.

The optimal layer may include an optimal model/controller selector configured to select any one combustion model and combustion controller among a plurality of combustion models and combustion controllers previously generated based on the real-time data, and a combustion optimization algorithm configured to calculate the target value by inputting the real-time data to the selected combustion model and combustion controller, and to output the control signal according to the calculated target value.

The optimal model/controller selector may select the combustion model having the smallest difference between the real-time data and estimation data estimated through the combustion model among the plurality of combustion models.

According to an aspect of still another exemplary embodiment, there is provided a method for managing combustion optimization, including: receiving, by a data collector, real-time data that is measured in real time from a boiler system including a boiler and a combustion controller configured to control combustion of the boiler, determining, by a management, whether to perform combustion optimization of the boiler based on the real-time data, and generating and transmitting, by an executor, a control command to the combustion controller to perform the combustion optimization of the boiler in response to determining that the combustion optimization of the boiler is possible.

The determining may include determining, by a management, whether to perform the combustion optimization of the boiler according to a predetermined condition by analyzing operation data in the real-time data, determining whether to perform the combustion optimization of the boiler according to the predetermined condition by analyzing a state binary value in the real-time data, or determining whether to perform the combustion optimization of the boiler through knowledge-based analysis that considers a predetermined range of operation data in the operation data and a value due to an influence between the operation data.

The determining whether to perform the combustion optimization of the boiler may include determining, by a boiler management of the management, whether a state of the boiler may perform the combustion optimization of the boiler by analyzing the real-time data, and determining, by a combustion control management of the management, whether a state of the combustion controller configured to control the combustion of the boiler may perform the combustion optimization of the boiler by analyzing the real-time data in response to determining that the state of the boiler may perform the combustion optimization of the boiler.

The transmitting the control command to the combustion controller may include transmitting the generated control command to the combustion controller to the combustion controller to perform the combustion optimization, if the boiler management determines that a state of the boiler may perform the combustion optimization of the boiler and the combustion control management determines that a state of the combustion controller configured to control the combustion of the boiler may perform the combustion optimization of the boiler.

The real-time data may include operation data and a state binary value measured from the boiler and the combustion controller.

The method for managing combustion optimization may further include selecting, by an optimal model/controller selector, any one combustion model and combustion controller among a plurality of combustion models and combustion controllers previously generated based on the real-time data, and calculating, by a combustion optimization algorithm, a target value by inputting the real-time data to the selected combustion model and combustion controller, and outputting a control signal according to the calculated target value.

The selecting the combustion model and the combustion controller may include selecting, by the optimal model/controller selector, the combustion model having the smallest difference between the real-time data and estimation data estimated through the combustion model among the plurality of combustion models.

As described above, according to one or more exemplary embodiments, it is possible to appropriately determine whether to perform the combustion optimization of the boiler according to the state of the boiler of the power plant to perform the combustion optimization of the boiler only in the necessary situation, thereby efficiently managing the boiler.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
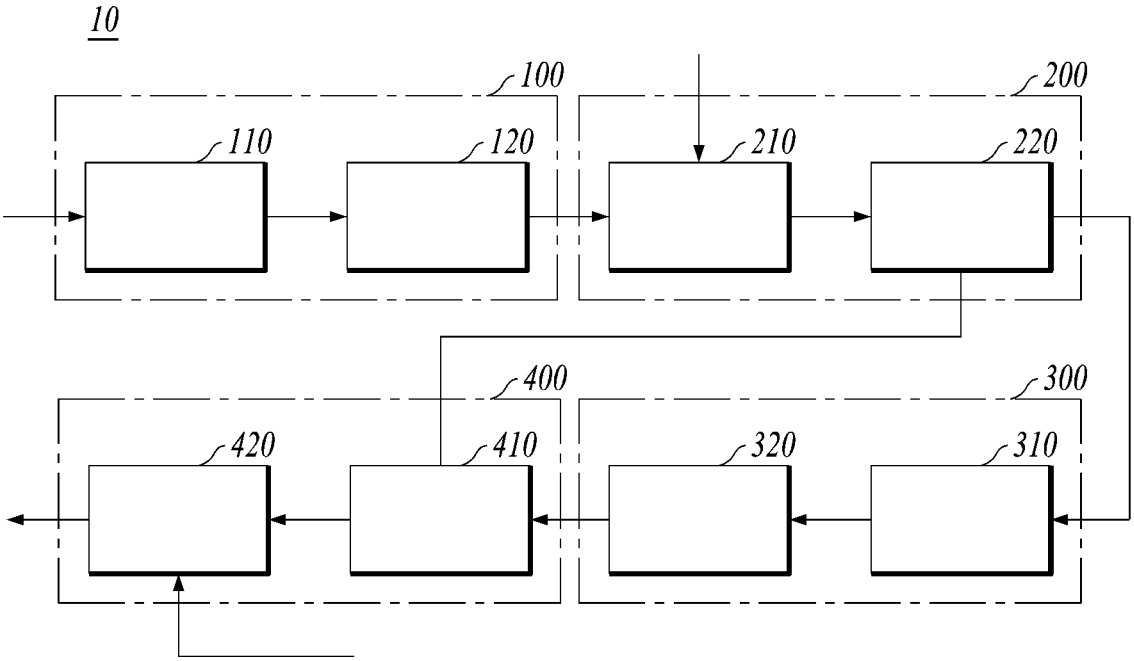
FIG. 1 is a block diagram for explaining a configuration of an apparatus for combustion optimization according to an exemplary embodiment.

Hereinafter, various modifications and various embodiments will be described in detail with reference to the accompanying drawings so that those skilled in the art may easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein. In order to clearly illustrate the disclosure in the drawings, some of the elements that are not essential to the complete understanding of the disclosure may be omitted, and like reference numerals refer to like elements throughout the specification.

The terminology used in the disclosure is for the purpose of describing specific embodiments only and is not intended to limit the scope of the disclosure. The singular expressions "a", "an", and "the" are intended to include the plural expressions as well unless the context clearly indicates otherwise. In the disclosure, terms such as "comprises," "includes," or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Also, "a module" or "a part" in the disclosure perform at least one function or operation, and these elements may be implemented as hardware or software, or as a combination of hardware and software. Further, a plurality of "modules" or "parts" may be integrated into at least one module and implemented as at least one processor, except "modules" or "parts" that need to be implemented as specific hardware.

Expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, all of a, b, and c, or any variations of the aforementioned examples.

FIG. 1 is a block diagram for explaining a configuration of an apparatus for combustion optimization according to an exemplary embodiment.

Referring to FIG. 1, a combustion optimization apparatus 10 according to an exemplary embodiment may include a management layer 100, a data layer 200, a model layer 300, and an optimal layer 400.

The management layer 100 is configured to manage combustion optimization, a combustion model, and a combustion controller by collecting currently measured real-time data for boiler combustion, and analyzing the collected real-time data. That is, the management layer 100 manages whether to perform the combustion optimization and whether to tune the combustion model and the combustion controller by analyzing the measured data. For this purpose, the management layer 100 may include a combustion management 110 and an auto-tuning management (model/controller) 120.

The combustion management 110 is configured to manage combustion optimization. A boiler system includes a boiler and a combustion controller for controlling the combustion of the boiler. The combustion management 110 determines whether to perform the combustion optimization based on real-time data which is measured in real time from the boiler system. Here, the real-time data includes operation data and a state binary value of the boiler. The operation data includes a value measured through a plurality of sensors with respect to the boiler, and a control value for controlling the boiler. The state binary value is a flag value indicating whether a change in a state of a parameter related to the boiler is out of a predetermined range. That is, the state binary value is data indicating a degree of change of the state, such as a variation of an output of the boiler, a variation of a fuel amount used, a variation of a fuel supply amount, a variation of a water supply amount, a variation of a combustion air supply amount, a variation of a coal supply amount, whether to operate a soot blower, or whether to operate boiler protection logic. For example, if the combustion air supply amount fluctuates within a predetermined range from the current value, the state binary value of the combustion air supply amount maintains "0", but if the combustion air supply amount changes by exceeding the predetermined range from the current value, the state binary value may be changed to "1".

The auto-tuning management (model/controller) 120 is configured to manage the combustion model and the combustion controller. The auto-tuning management (model/controller) 120 determines whether to tune the combustion model and the combustion controller based on the real-time data measured in real time and whether to perform the combustion optimization. Here, only when the auto-tuning management (model/controller) 120 determines to perform tuning, a combustion model design algorithm 310 and a combustion controller design algorithm 320 operate. On the other hand, when the auto-tuning management (model/controller) 120 determines not to perform tuning, the combustion model design algorithm 310 and the combustion controller design algorithm 320 do not operate. The data layer 200 is configured to pre-process and sort data to generate learning data necessary for the design of the combustion model and controller. That is, the data layer 200 extracts the learning data necessary for the design of the combustion model and the combustion controller from the currently measured real-time data for the boiler combustion and past data previously measured and stored for the boiler combustion. The data layer 200 may include a data pre-processor 210 and a data analyzer 220.

The data pre-processor 210 pre-processes data including real-time data and past data. The data pre-processor 210 performs at least one pre-processing of signal restoration, filtering, and outlier processing. Here, the signal restoration means restoring missing data, the filtering means filtering data suitable for the condition based on base knowledge or data, and the outlier processing means an operation of erasing data that exceeds an upper limit value or falls below a lower limit value. This pre-processing may remove noise in the data or remove data that may adversely affect in designing or tuning the combustion model and the combustion controller in advance.

The data analyzer 220 derives learning data by analyzing the pre-processed data. The data analyzer 220 analyzes a correlation between the data based on a tag of the data, clusters the data, and selects the input data whose correlation degree is a predetermined value or more for model output data through the correlation analysis for the design of the combustion model. Accordingly, the input data and the target data corresponding thereto may be derived. Further, the data analyzer 220 performs sampling for sorting the data in a steady state necessary for the design of the combustion model and the combustion controller through a pattern analysis of the data.

The model layer 300 is configured to generate the combustion model and the combustion controller based on the learning data. The model layer 300 may include the combustion model design algorithm 310 and the combustion controller design algorithm 320.

The combustion model design algorithm 310 designs the combustion model, which is one of the most important factors for optimizing the boiler combustion. The combustion model design algorithm 310 generates the combustion model based on the learning data. That is, the combustion model design algorithm 310 constitutes the combustion model for outputting predictive data predicting factors such as the power generation output, the combustion state including the temperature of the steam and the exhaust gas, the composition of the exhaust gas (e.g., carbon monoxide, nitrogen oxide), and the residual oxygen amount after the combustion, which are important variables for combustion based on the input data including the real-time data and the past data such as fuel input amount, air input amount, water input amount, and air temperature.

The combustion model according to an exemplary embodiment is generated based on at least one of a plurality of parametric models including a transfer function model and a state space model and a plurality of nonparametric models. Table 1 below shows an example of the parametric model and the non-parametric model according to the exemplary embodiment.

TABLE 1

| | | | |
|---|---|---|---|
| Parametric Model | Transfer Function | Equation Error | Auto-Regressive eXogeneous (ARX) |
| | | | Nonlinear Auto-Regressive eXogeneous (NARX) |
| | | | Finite Impulse Response (FIR) |
| | | | Auto-Regressive Moving Average eXogenious (ARMAX): Pseudolinear Regression Model |
| | | | Auto-Regressive (AR) |
| | | | Auto-Regressive Moving Average (ARMA) |
| | | | Auto-Regressive Auto-Regressive eXogeneous (ARARX): Generalized Least-Squares Model |
| | | | Auto-Regressive Auto-Regressive Moving Average eXogeneous (ARARMAX): Extended Matrix Model |
| | | Output Error | Output Error (OE) |
| | | | Box and Jenkins (BJ) |
| | | Linear Time Invariant (LTI), Linear Time Variant (LTV) | |
| | | Linear Model, Nonlinear Model | |
| | State Space | Continuous Time, Discrete Time, Delay Time | |
| | | Single Input Single Output (SISO), | |
| | | Multi Input Multi Output (MIMO) | |
| | | Stochastic Model, Deterministic Model | |
| | | Robust, Open Loop, Closed Loop | |
| Non Parametric Model | Non Parametric (Data Set Type) | | |
| | Impulse Response | | |
| | Step Response | | |
| | Frequency Transfer Function | | |
| | Tree | | |
| | Neural Network (NN): FF, FB, Radial Basis Function, Convolutional, Spiking, Deep NN (Deep Belief Network), Recurrent NN | | |

Further, the combustion model may be derived by using at least one of the optimization algorithms listed in Table 2 below.

TABLE 2

| | |
|---|---|
| Parametric Model | Prediction Error Method (PEM) |
| | Maximum Likelihood Method (MLM) |
| | Least-Squares Method (LSM) |
| | Batch Least-Squares Method |
| | Off-line Least-Squares Method |
| | Extended Least-Squares Method (ELSM) |
| | Generalized Least-Squares Method (GLSM) |
| | Recursive Least-Squares Method (RLS) |
| | Instrumental Variable Method (IVM) |
| | Principle Component Analysis (PCA) |
| | Dynamic Principle Component Analysis (DPCA) |
| | Partial Least Squares (PLS) |
| | SubSpace-based State Space Model |
| | Identification (4SID) Method |
| | (+Singular Value Decomposition (SVD)) |
| | (+QR Decomposition) |
| | N4SID Method |
| | Multivariable Output Error State sPace (MOESP) Method |
| | Canonical VariateAnalysis (CVA) |

TABLE 2-continued

| | |
|---|---|
| | Singular Value Decomposition |
| | Minimal Realization Method (MRM) |
| Non Parametric Model | Transient Response Method |
| | Correlation Analysis |
| | Frequency Response Method |
| | Spectral Analysis Method |
| | Empirical Transfer Function Estimate (ETFE) Method |
| | Single/Multi-Layer Perceptron Learning, Back-Propagation, Gradient Descent |
| | LayerwisePretraining: Auto-Encoder, BolzmannMachine |

The combustion controller design algorithm 320 designs the combustion controller, which is one of the most important factors for optimizing the boiler combustion based on the learning data. The designed combustion controller serves to produce the optimal target value for optimal combustion control. At this time, the combustion model is used to produce the optimal target value. The combustion controller derives the predictive data based on the input data including the real-time data and the past data through the combustion model, and derives the optimal target value with reference to the derived predictive data.

The optimal layer 400 is configured to select the optimal combustion model and combustion controller, and calculate the optimal target value for combustion optimization by using the selected combustion model and combustion controller. The optimal layer 400 may include an optimal model/controller selector 410 and a combustion optimization algorithm 420.

The optimal model/controller selector 410 selects the most optimal combustion model and combustion controller among several combustion models and combustion controllers that have been previously produced based on the analysis results of real-time data.

The optimal model/controller selector 410 analyzes the real-time data and the past data. Here, the analysis includes 1) base knowledge-based data analysis and 2) data-based analysis. As a result of the data analysis, information on a pattern of real-time data, a change in power generation output, an efficiency condition, and a driving condition may be derived. The optimal model/controller selector 410 selects an optimal combustion model to be used for the combustion control based on the information derived according to the result of the data analysis. Further, the optimal model/controller selector 410 selects an optimal combustion controller for the combustion optimization by using the result of the data analysis and the combustion model.

The combustion optimization algorithm 420 calculates the optimal target value for the combustion optimization by inputting the real-time data to the combustion model and combustion controller selected by the optimal model/controller selector 410, and outputs a control signal according to the calculated target value. Here, the target value includes an optimal control target value calculated by using the set points and the manual bias in the current DCS and an auxiliary value associated with the control target value.

Figure 2:
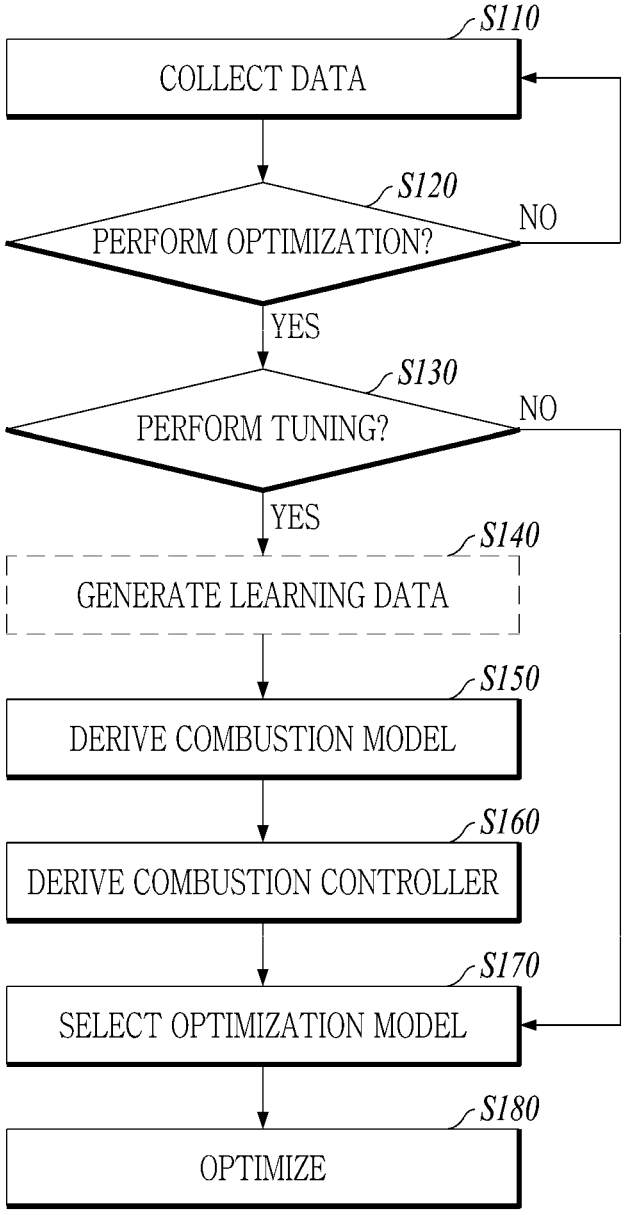
FIG. 2 is a flowchart for explaining a method for optimizing combustion according to an exemplary embodiment.

FIG. 2 is a flowchart for explaining a method for optimizing combustion according to an exemplary embodiment.

Referring to FIG. 2, the combustion management 110 of the management layer 100 collects currently measured real-time data for the boiler combustion of a power plant (operation S110). This real-time data includes the operation data and the state binary value of the boiler. The operation data includes a value measured through a plurality of sensors with respect to the boiler, and a control value for controlling the boiler. The state binary value is a flag value indicating whether the change in the state of the parameter related to the boiler is out of the predetermined range. Here, the state binary value is data indicating the degree of change of the state, such as a variation of output of the boiler, a variation of fuel amount used, a variation of the fuel supply amount, a variation of the water supply amount, a variation of the combustion air supply amount, a variation of the coal supply amount, whether to operate a soot blower, and whether to operate boiler protection logic. For example, if the combustion air supply amount fluctuates within a predetermined range from the current value, the state binary value of the combustion air supply amount maintains "0", but if the combustion air supply amount changes by exceeding the predetermined range from the current value, the state binary value may be changed to "1".

The combustion management 110 determines whether to perform the optimization according to a predetermined condition based on the collected data (operation S120). At this time, the combustion management 110 may determine whether to perform the optimization through the operation data-based analysis, the state binary value-based analysis, and the analysis reflecting the knowledge and experience of the expert. For example, according to the analysis reflecting the knowledge and experience of the expert, it is possible to determine whether to perform the optimization according to whether the range of specific operation data such as NOx, CO, and Unit Load Demand and the value according to the influence between the data are normal. The combustion management 110 may derive whether the optimization control of the boiler is applicable and whether the combustion optimization may be performed, and determine to perform the optimization when two values are true.

If it is determined to perform the optimization in operation S120, the auto-tuning management (model/controller) 120 of the management layer 100 determines whether to tune the combustion model and the combustion controller based on at least one of the real-time data, whether to perform the combustion optimization and whether to perform learning for the tuning of the combustion model and the combustion controller (operation S130).

If it is determined to perform the tuning in operation S130, the data layer 200 generates the learning data necessary for the design of the combustion model and the combustion controller by pre-processing and sorting the currently measured real-time data and the past data previously measured (operation S140). The data pre-processor 210 of the data layer 200 performs the pre-processing for the currently measured real-time data and the previously measured past data (operation S140). At this time, the data pre-processor 210 may perform at least one of signal restoration for restoring missing data, filtering for filtering the data satisfying a predetermined condition based on base knowledge or data, and outlier processing for erasing the data exceeding the upper limit value or falling below the lower limit value by pre-processing. Accordingly, the data, etc. that may adversely affect in removing the noise in the tag data or designing the combustion model and the combustion controller are erased in advance. Further, the data analyzer 220 of the data layer 200 performs the sampling of sorting only the important data of the steady state necessary for designing the combustion model and the combustion controller through the pattern analysis of the data, and selects input variables whose correlation degree is a predetermined value or more for the output variables of the combustion model and the combustion controller through the correlation analysis, etc. for designing the combustion model (operation S140). That is, the data analyzer 220 generates the learning data through the sampling and the input variable selection.

Next, the combustion model design algorithm 310 of the model layer 300 generates the combustion model based on the learning data (operation S150). The combustion model according to an exemplary embodiment may be generated based on at least one of the parametric model including the transfer function model and the state space model and the nonparametric model as shown in Table 1. The combustion model design algorithm 310 may derive the combustion model by using at least one of the optimization algorithms as shown in Table 2 by applying the learning data to at least one of the parametric model and the nonparametric model. This combustion model is configured to predict factors such as the power generation output, the combustion state including the temperature of the steam and the exhaust gas, the composition of the exhaust gas (e.g., carbon monoxide, nitrogen oxide), and the residual oxygen amount after the combustion, which are important variables for combustion, based on the input such as fuel input amount, air input amount, water input amount, and air temperature.

The combustion controller design algorithm 320 of the model layer 300 derives the combustion controller based on the learning data (operation S160). The designed combustion controller serves to produce the target value for the optimal combustion control. The combustion model is used to produce the optimal target value.

The optimal model/controller selector 410 of the optimal layer 400 selects the optimum combustion model and combustion controller among the plurality of combustion models and combustion controllers previously generated based on the analysis result of the currently measured real-time data (operation S170).

The optimal model/controller selector 410 firstly selects the combustion model by analyzing the real-time data (operation S170). Here, the optimal model/controller selector 410 selects the combustion model having the smallest residual, for example, the difference between the currently measured real-time data for the boiler combustion and the estimation data estimated through the combustion model among the plurality of combustion models. Thereafter, the optimal model/controller selector 410 selects the combustion controller based on the selected combustion model.

Further, the combustion optimization algorithm 420 of the optimal layer 400 calculates the optimal target value for the combustion optimization by inputting the currently measured real-time data to the previously selected combustion model and combustion controller, and outputs the control signal according to the calculated target value (operation S180). Here, the target value includes the control target value and the auxiliary value corresponding to the control target value.

Figure 3:
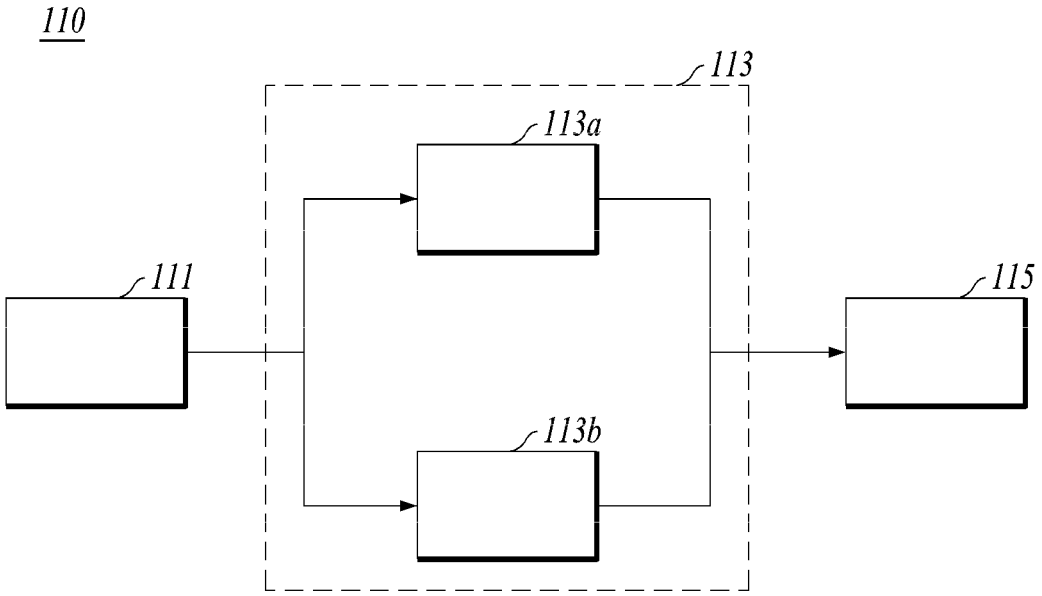
FIG. 3 is a block diagram for explaining a configuration of an apparatus for managing combustion optimization according to an exemplary embodiment.

FIG. 3 is a block diagram for explaining a configuration of an apparatus for managing combustion optimization according to an exemplary embodiment.

Referring to FIG. 3, the combustion management 110 of the management layer 100 may include a data collector 111, a management 113, and an executor 115.

A boiler system includes a boiler and a combustion controller configured to control the combustion of the boiler. The data collector 111 receives real-time data which is measured in real time from the boiler system. Here, the real-time data includes the operation data and the state binary value of the boiler. The operation data includes a value measured through a plurality of sensors with respect to the boiler, and a control value for controlling the boiler. The state binary value is a flag value indicating whether the change in the state of the parameter related to the boiler is out of a predetermined range. At this time, the state binary value is data indicating the degree of change of the state, such as a variation of the output of the boiler, a variation of the fuel amount used, a variation of the fuel supply amount, a variation of the water supply amount, a variation of the combustion air supply amount, a variation of the coal supply amount, whether to operate a soot blower, or whether to operate boiler protection logic. For example, if the combustion air supply amount fluctuates within a predetermined range from the current value, the state binary value of the combustion air supply amount maintains "0", but if the combustion air supply amount changes by exceeding the predetermined range from the current value, the state binary value may be changed to "1".

The management 113 determines whether to perform the combustion optimization of the boiler based on the real-time data. At this time, the management 113 may determine whether to perform the combustion optimization of the boiler according to a predetermined condition by analyzing the operation data in the real-time data. Further, the management 113 may determine whether to perform the combustion optimization of the boiler according to the predetermined condition by analyzing the state binary value in the real-time data. Further, the management 113 may determine whether to perform the combustion optimization of the boiler through the knowledge-based analysis that simultaneously considers the range of the specific operation data and the value due to the influence between the specific operation data. This knowledge-based analysis sets a condition based on the knowledge and experience of the expert, and performs the analysis according to this condition. For example, the knowledge-based analysis analyzes whether the values such as NOx, CO, and Unit Load Demand fall within the normal value range of the predetermined condition.

The management 113 may include a boiler management 113*a* and a combustion control management 113*b*.

The boiler management 113*a* determines whether the state of the boiler may perform the combustion optimization of the boiler by analyzing the real-time data.

The combustion control management 113*b* determines whether the state of the combustion controller configured to control the combustion of the boiler may perform the combustion optimization of the boiler by analyzing the real-time data. Here, the combustion control management 113*b* determines whether the boiler system may perform the combustion optimization by analyzing the real-time data to analyze the integrity of the entire boiler system and the integrity of each module of the boiler system. For example, the combustion control management 113*b* may determine the integrity of the combustion controller through whether the hardware operations such as the system resource status and the normal communication availability are normal by analyzing the real-time data. Further, the combustion control management 113*b* may determine the integrity of each module of the combustion controller through whether the software operation such as the presence of the combustion model is normal by analyzing the real-time data.

If the boiler management 113*a* determines that the state of the boiler may perform the combustion optimization of the boiler and at the same time, the combustion control management 113*b* determines that the state of the combustion controller configured to control the combustion of the boiler may perform the combustion optimization of the boiler, the executor 115 transmits a control command by generating the control command for the combustion controller to perform the combustion optimization.

Figure 4:
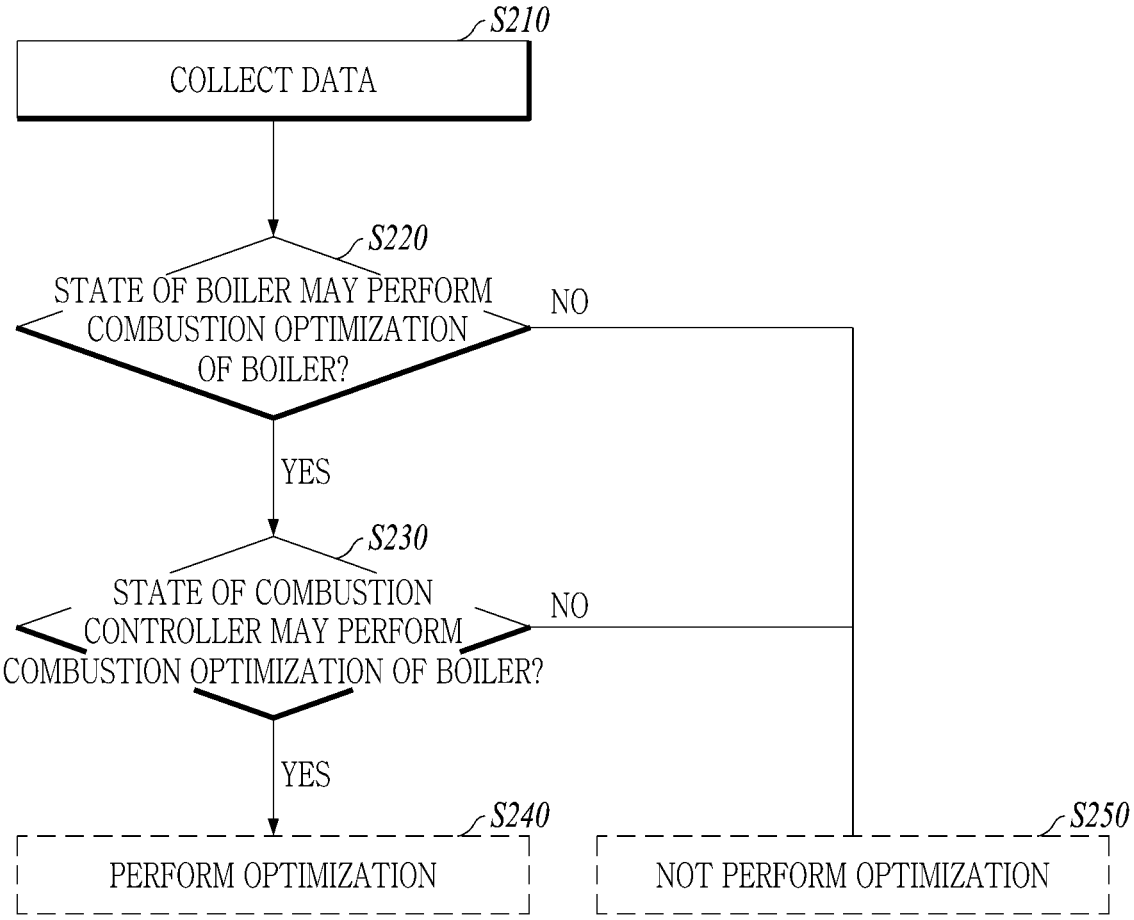
FIG. 4 is a flowchart for explaining a method for managing combustion optimization according to an exemplary embodiment.

FIG. 4 is a flowchart for explaining a method for managing combustion optimization according to an exemplary embodiment.

Referring to FIG. 4, the data collector 111 of the combustion management 110 receives the real-time data which is measured in real time from the boiler system (operation S210). Here, the boiler system includes the boiler and the combustion controller configured to control the combustion of the boiler. Further, the real-time data includes the operation data and the state binary value measured from the boiler and the combustion controller.

The operation data includes a value measured through a plurality of sensors with respect to the boiler, and a control value for controlling the boiler. The state binary value is a flag value indicating whether the change in the state of the parameter related to the boiler is out of a predetermined range. At this time, the state binary value is data indicating the degree of change of the state, such as a variation of the output of the boiler, a variation of the fuel amount used, a variation of the fuel supply amount, a variation of the water supply amount, a variation of the combustion air supply amount, a variation of the coal supply amount, whether to operate a soot blower, or whether to operate boiler protection logic. For example, if the combustion air supply amount fluctuates within a predetermined range from the current value, the state binary value of the combustion air supply amount maintains "0", but if the combustion air supply amount changes by exceeding the predetermined range from the current value, the state binary value may be changed to "1".

The management 113 may determine whether to perform the combustion optimization of the boiler based on the real-time data. At this time, the management 113 may determine whether to perform the combustion optimization of the boiler according to a predetermined condition by analyzing the operation data in the real-time data. Further, the management 113 may determine whether to perform the combustion optimization of the boiler according to a predetermined condition by analyzing the state binary value in the real-time data. Further, the management 113 may determine whether to perform the combustion optimization of the boiler through the knowledge-based analysis that simultaneously considers the range of the specific operation data and the value due to the influence between the specific operation data. This knowledge-based analysis sets a condition based on the knowledge and experience of the expert, and performs the analysis according to this condition. For example, the knowledge-based analysis analyzes whether the values such as NOx, CO, and Unit Load Demand fall within the normal value range of the predetermined condition.

For example, the boiler management 113*a* of the management 113 determines whether the state of the boiler may perform the combustion optimization of the boiler by analyzing the real-time data (operation S220). If it is determined that the state of the boiler may perform the combustion optimization of the boiler in operation S220, it progresses to an operation S230. On the other hand, if it is not possible, it progresses to an operation S250 not to perform the combustion optimization of the boiler.

The combustion control management 113*b* of the management 113 determines whether the state of the combustion controller configured to control the combustion of the boiler may perform the combustion optimization of the boiler by analyzing the real-time data (operation S230). Here, the combustion control management 113*b* determines whether the boiler system may perform the combustion optimization of the boiler by analyzing the real-time data to analyze the integrity of the entire boiler system and each module of the boiler system. For example, the combustion control management 113*b* may determine the integrity of the combustion controller through whether the hardware operations such as the system resource status and the normal communication availability are normal by analyzing the real-time data. Further, the combustion control management 113*b* may determine the integrity of each module of the combustion controller through whether the software operation such as the presence of the combustion model is normal by analyzing the real-time data.

If it is determined that the combustion optimization of the boiler may be performed in operation S230, it progresses to an operation S240. On the other hand, if it is not possible, it progresses to an operation S250 not to perform the combustion optimization of the boiler.

Because the boiler management 113*a* has determined that the optimization control may be applied to the boiler and at the same time, the combustion control management 113*b* has determined that the combustion controller may perform the combustion optimization of the boiler, the executor 115 transmits a control command by generating the control command for the combustion controller to perform the combustion optimization of the boiler (operation S240).

Figure 5:
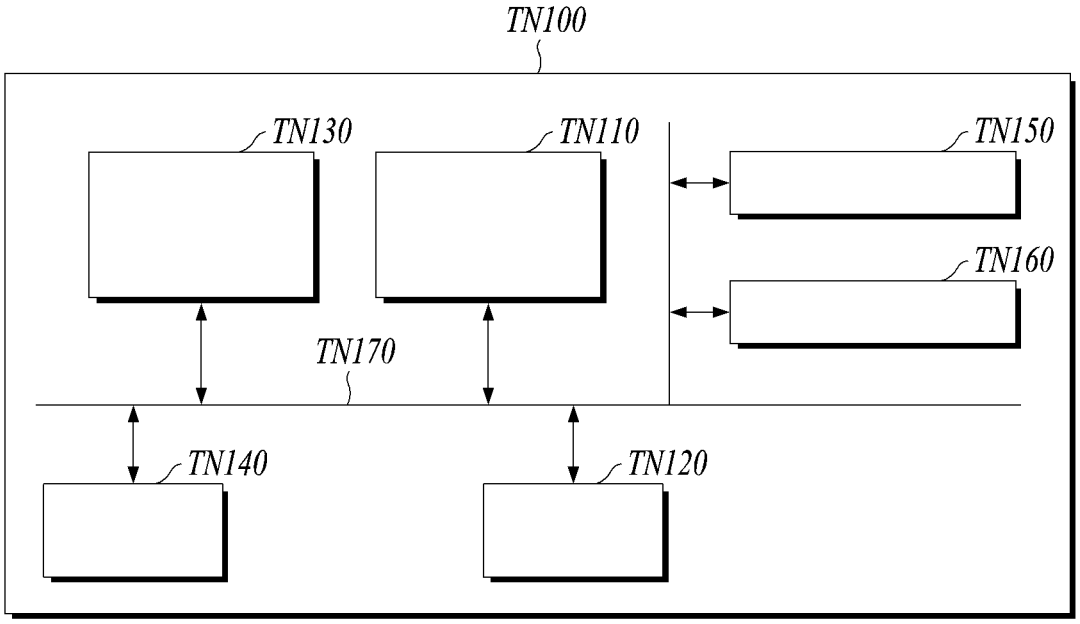
FIG. 5 is a diagram showing a computing apparatus according to an exemplary embodiment.

FIG. 5 is a diagram showing a computing apparatus according to an exemplary embodiment. The computing apparatus TN100 may be an apparatus described in the present disclosure (e.g., an apparatus for managing combustion optimization, a combustion optimization apparatus, etc.).

Referring to FIG. 5, the computing apparatus TN100 may include at least one processor TN 110, a transceiver TN 120, and a memory TN 130. The computing apparatus TN100 may further include a storage TN140, an input interface TN150, an output interface TN160, etc. The components included in the computing apparatus TN100 may be connected by a bus TN170 to perform the communication therebetween.

The processor TN110 may execute a program command stored in at least one of the memory TN130 and the storage TN140. The processor TN110 may include a central processing unit (CPU), a graphics processing unit (GPU), or a dedicated processor on which methods according to an exemplary embodiment are performed. The processor TN110 may be configured to implement the procedures, functions, methods, etc. described in connection with an exemplary embodiment. The processor TN110 may control each component of the computing apparatus TN100.

Each of the memory TN130 and the storage TN140 may store various information related to the operation of the processor TN110. Each of the memory TN130 and the storage TN140 may be composed of at least one of a volatile storage medium and a nonvolatile storage medium. For example, the memory TN130 may be composed of at least one of a read only memory (ROM) and a random access memory (RAM).

The transceiver TN120 may transmit or receive a wired signal or a wireless signal. The transceiver TN120 may be connected to a network to perform communication.

Meanwhile, various methods according to an exemplary embodiment described above may be implemented in the form of the readable program through various computer means to be recorded in a computer-readable recording medium. Here, the recording medium may include program commands, data files, data structures, etc. alone or in combination. The program command recorded on the recording medium may be those specially designed and configured for an exemplary embodiment or may also be known and available to those skilled in the art of computer software. For example, the recording medium may include a magnetic media such as a hard disk, a floppy disk, and a magnetic tape, an optical media such as a CD-ROM and a DVD, a magneto-optical media such as a floptical disk, and hardware apparatuses that are specially configured to store and execute the program command such as a ROM, a RAM, and a flash memory. Examples of the program command may include not only machine language wires such as those produced by a compiler, but also high-level language wires that may be executed by a computer by using an interpreter or the like. Such a hardware apparatus may be configured to operate as one or more software modules in order to perform the operation of an exemplary embodiment, and vice versa.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. An apparatus for managing a boiler system, the apparatus comprising a processor, memory including computer program commands, and a storage, wherein the program commands are executed by the processor, the program commands comprise:

collecting real-time data from the boiler system comprising a boiler and a combustion controller configured to control a combustion of the boiler, wherein the real-time data measured from the boiler system includes operation data and a state binary value;

determining whether to perform a combustion optimization of the boiler based on the state binary value, wherein the state binary value is true (1) when a change of a boiler parameter exceeds a predetermined range, and the combustion optimization is performed by executing one of a plurality of combustion models;

determining whether the combustion controller is capable of performing the combustion optimization based on a communication availability of the boiler system and a presence of the plurality of combustion models;

generating and transmitting a control command to the combustion controller to select an optimal combustion model from the plurality of combustion models if the performing of the combustion optimization of the boiler is determined and the combustion controller is determined to be capable of performing the combustion optimization;

selecting the optimal combustion model from the plurality of combustion models based on the real-time data, wherein the optimal combustion model is used for a combustion control of the boiler and the plurality of combustion models is Recurrent Neural Network (RNN) models; and outputting an optimal target value for the combustion control by inputting the real-time data to the selected optimal combustion model, and outputting a control signal according to the optimal target value, wherein the selected combustion model has a smallest difference between the real-time data and the estimated factors, wherein the estimated factors is estimated through each combustion model of the plurality of combustion models.

2. The apparatus of claim 1, wherein the state binary value includes a variation of an output of the boiler, a variation of a fuel amount used, a variation of a fuel supply amount, a variation of a water supply amount, a variation of a combustion air supply amount, and a variation of a coal supply amount; and the operation data includes a value measured through a plurality of sensors of the boiler, and a control value for controlling the boiler.

3. The apparatus of claim 1, wherein the plurality of combustion models is configured to estimate factors including a power generation output, a temperature of steam, and a composition of exhaust gas based on input data including a fuel input amount, an air input amount, and a water input amount.

4. The apparatus of claim 1, wherein the inputting of the real-time data to the selected optimal combustion model is performed by the combustion controller.

5. A method for managing a boiler system comprising:

collecting real-time data from the boiler system comprising a boiler and a combustion controller configured to control a combustion of the boiler, wherein the real-time data measured from the boiler system includes operation data and a state binary value;

determining whether to perform a combustion optimization of the boiler based on the state binary value, wherein the state binary value is true (1) when a change of a boiler parameter exceeds a predetermined range, and the combustion optimization is performed by executing one of a plurality of combustion models;

determining whether the combustion controller is capable of performing the combustion optimization based on a communication availability of the boiler system and a presence of the plurality of combustion models;

generating and transmitting a control command to the combustion controller to select an optimal combustion model from the plurality of combustion models if the performing of the combustion optimization of the boiler is determined and the combustion controller is determined to be capable of performing the combustion optimization;

selecting the optimal combustion model from the plurality of combustion models based on the real-time data, wherein the optimal combustion model is used for a combustion control of the boiler and the plurality of combustion models is Recurrent Neural Network (RNN) models; and outputting an optimal target value for the combustion control by inputting the real-time data to the selected optimal combustion model, and outputting a control signal according to the optimal target value, wherein the selected combustion model has a smallest difference between the real-time data and the estimated factors, wherein the estimated factors is estimated through each combustion model of the plurality of combustion models.

6. The method of claim 5, wherein the state binary value includes a variation of an output of the boiler, a variation of a fuel amount used, a variation of a fuel supply amount, a variation of a water supply amount, a variation of a combustion air supply amount, and a variation of a coal supply amount; and the operation data includes a value measured through a plurality of sensors with respect to the boiler, and a control value for controlling the boiler.

7. The method of claim 5, wherein the plurality of combustion models is configured to estimate factors including a power generation output, a temperature of steam, and a composition of exhaust gas based on input data including a fuel input amount, an air input amount, and a water input amount.

8. The method of claim 5, wherein the inputting of the real-time data to the selected optimal combustion model is performed by the combustion controller.

* * * * *